US009187944B2

(12) United States Patent
Cianetti

(10) Patent No.: US 9,187,944 B2
(45) Date of Patent: Nov. 17, 2015

(54) OPENING SYSTEM WITH RIGHT ANGLE GEARBOX FOR COUNTERS AND CABINETS

(71) Applicant: N.E.M. NORD EST MECCANICA S.n.c, San Pier D'Isonzo (IT)

(72) Inventor: Alessandro Cianetti, San Pier D'Isonzo (IT)

( * ) Notice: Subject to any disclaimer, the term of this patent is extended or adjusted under 35 U.S.C. 154(b) by 479 days.

(21) Appl. No.: 13/656,864

(22) Filed: Oct. 22, 2012

(65) Prior Publication Data

US 2013/0098184 A1 Apr. 25, 2013

(30) Foreign Application Priority Data

Oct. 20, 2011 (IT) ..... G02011A0006-20

(51) Int. Cl.

| | |
|---|---|
| ***E05D 7/00*** | (2006.01) |
| ***E05F 3/20*** | (2006.01) |
| ***E05F 15/53*** | (2015.01) |
| *A47F 3/00* | (2006.01) |

(52) U.S. Cl.

CPC ..... *E05F 15/53* (2015.01); *A47F 2003/008* (2013.01); *E05Y 2900/204* (2013.01); *Y10T 74/18784* (2015.01)

(58) Field of Classification Search

CPC ..... A47F 2003/008; A47F 3/11; E05F 9/00; E05F 15/121; E05D 3/122; E05Y 2900/20

USPC ..... 16/354, 82, 286, 62, 64, 69, 71, 78, 79, 16/63, 66, 54, 50; 220/827, 263, 264; 49/136, 137, 138, 333, 334, 335, 49/340–342; 74/412 R, 416; 312/326–329, 312/319.5, 319.6, 319.7, 319.8

See application file for complete search history.

(56) References Cited

U.S. PATENT DOCUMENTS

| | | | | |
|---|---|---|---|---|
| 1,705,320 | A * | 3/1929 | Venegas | 359/854 |
| 2,078,815 | A * | 4/1937 | Segar | 16/286 |
| 2,626,420 | A * | 1/1953 | Mongin et al. | 16/79 |
| 2,654,117 | A * | 10/1953 | Pattison et al. | 16/295 |
| 2,959,808 | A * | 11/1960 | Limberg | 16/354 |
| 2,963,171 | A * | 12/1960 | Johnson | 108/139 |
| 4,887,392 | A * | 12/1989 | Lense | 49/300 |
| 5,219,372 | A * | 6/1993 | Lee | 16/54 |
| 5,269,048 | A * | 12/1993 | Pazmany | 16/354 |
| 5,553,353 | A * | 9/1996 | Lin | 16/82 |
| 5,862,896 | A * | 1/1999 | Villbrandt et al. | 188/293 |
| 6,176,044 | B1 * | 1/2001 | Nixon et al. | 49/506 |
| 7,194,840 | B2 * | 3/2007 | Zimmermann | 49/324 |

(Continued)

FOREIGN PATENT DOCUMENTS

| | | |
|---|---|---|
| DE | 9421138 U1 | 5/1995 |
| DE | 19913435 A1 | 9/2000 |

*Primary Examiner* — Chuck Mah

(57) ABSTRACT

An opening system comprising an upper bearing section bar (1) fastened to the vertical rods, a gripper for the plate (4) made up of a first section bar (2) and of a second section bar (3) and at least one moving device (5) for the plate (4); each moving device (5) is made up of a support section bar (6), a right angle gearbox, an arm (7), a gas spring (8) and a clamp (9); the right angle gearbox is made up of a first conical cogwheel (10) and a second conical cogwheel (11) engaging each other; the arm of the first conical cogwheel (10) acts as lever, transforming the axial movement of the rod of the gas spring (8) into a radial movement of the second conical cogwheel (11) and of the elements linked thereto: clamp (9), gripper for the plate (4) and plate itself (4).

6 Claims, 5 Drawing Sheets

(56) References Cited

U.S. PATENT DOCUMENTS

| | | | | |
|---|---|---|---|---|
| 7,512,426 | B2 * | 3/2009 | Maatta et al. | 455/575.1 |
| 2001/0039762 | A1 * | 11/2001 | Giovannetti | 49/246 |
| 2002/0113532 | A1 * | 8/2002 | Hornberger et al. | 312/323 |
| 2003/0080131 | A1 * | 5/2003 | Fukuo | 220/264 |
| 2004/0034968 | A1 * | 2/2004 | Williams | 16/354 |
| 2007/0267432 | A1 * | 11/2007 | Woods et al. | 221/28 |
| 2008/0172834 | A1 * | 7/2008 | Sutterlutti | 16/286 |
| 2009/0064457 | A1 * | 3/2009 | Brustle | 16/292 |
| 2011/0193458 | A1 * | 8/2011 | Omann | 312/319.2 |

* cited by examiner

OPENING SYSTEM WITH RIGHT ANGLE GEARBOX FOR COUNTERS AND CABINETS

FIELD OF APPLICATION

The system that is the object of the patent can be validly used in the field of chiller cabinets and of hot or neutral counters which are destined to the retail sale of both food products and no-food products, such as jewelry, electronics, toys, etc.

STATE OF THE ART

Counters and cabinets for the display and sale of food and no-food products are always equipped with glass or plastic plates having the most varied sizes and lengths in order to fulfill the different needs. The function of the plates is to isolate the products contained in the counters and cabinets from the outer environment and/or to prevent customers from touching the displayed goods. The plates are fixed in various ways to a lower frame or to an upper frame supported by vertical rods.

The opening systems with a lower frame in which the plate opens downwards are moderately useful, user-friendly, cost-effective, but present problems due to the difficulty of cleaning the inner part of the plate as well as the display area of the counter or cabinet. Such downward opening systems do not allow frontal loading and unloading operations. Furthermore, in systems in which the large plates are opened downwards, they shall be supported during the above mentioned operations in order to prevent hinges from breaking or even from detaching themselves from the counter. The users thus face twice the discomfort: on the one side the effort of sustaining the plates, on the other side the impossibility of moving along the counter or cabinet as most of it is occupied by the open plates.

The systems with a traditional upper frame with front or rear vertical rods, though useful, present some problems. First of all, to support the plates it is necessary to use section bars with a remarkable cross section or more section bars linked to each other in order to avoid the torsions due to the force exercised by the piston to lift the plates as well as the bending due to the weight of the plates.

In order to avert such problems, the number of vertical rods is raised, thus limiting the visibility of the displayed product in case of front rods or the users' access to the display area in case of rear rods. For instance, a chiller counter with two glass plates and a traditional superstructure with upward opening shall be produced with a minimum of three front vertical rods or three rear vertical rods supporting the frame.

Multiple solutions to open the plates in display counters with an upper frame are marketed.

SUMMARY OF THE INVENTION

The invention that is the object of the patent aims at providing the users with a new upward plate-moving system for display counters which is simple, safe and cost-efficient, if compared to the upward opening systems available on the market at present, and which thus solves the above mentioned problems.

This and other aims are reached by the opening system that is the object of the patent, as best described in the first claim.

The opening system that is the object of the patent is used in counters and cabinets having a bearing section bar fixed to the upper end of the vertical rods with a length equal to the length of the counter or cabinet, which has a gripper for each plate made up of a first section bar and of a second section bar. The two section bars forming the gripper are connected to one or more moving devices, according to the weight and size of the plate.

Each plate moving device comprises a support section bar, a right angle gearbox or a pivot joint, an arm, an element which can take the initial form again as soon as the forces acting on it cease to do so as well as a clamp. Said element is a gas spring or an elastic element.

The right angle gearbox is made up of a first conical cogwheel and of a second conical cogwheel engaging each other. The first conical cogwheel is pivoted onto the support section bar and an end of the arm is fastened to it. A first end of the gas spring or elastic element is pivoted onto the second end of the arm.

The second end of the gas spring or elastic element is pivoted onto the support section bar. The second conical cogwheel is clamped in the axial direction onto the clamp, which is linked to the two section bars forming the gripper supporting the plate.

The arm of the first conical cogwheel is helped by the gas spring or elastic element and acts as lever, thus transforming the axial movement of the rod of the gas spring into a radial movement of the second conical cogwheel and of the elements linked thereto: clamp, two section bars forming the gripper for the plate and the plate itself. The movement is smooth and there is no energy loss thanks to the geometry of the conical cogwheels and to their transmission ratio.

Thanks to this system, only two side vertical rods are necessary, thus allowing the customers' unblocked view and leaving the back working surface free for the user. This is due to the fact that, thanks to the right angle gearbox, the force exercised onto the gas spring or elastic element by the weight of the plate is unloaded longitudinally to the plate and its opening, thus allowing the use of a bearing section bar with a moderate cross section, as it is less exposed to bending and torsions.

The system has other advantages, as well:

- the right angle gearbox is mounted and ready to be fastened to the bearing section bar/s, the amount of which the customers will order according to their needs;
- various complex machine tools are no longer necessary to mount the moving device onto the bearing section bar, a saw for section bars and a drill are enough, which reduces time and costs;
- as soon as the moving device is mounted onto the bearing section bar, it is isolated from the outer environment, especially from food products, which presents the logical advantages from a health-related point of view;
- the moving device and its bearing section bar can also be used for counters with no vertical rods and can be fixed only laterally onto jambs made of wood, glass, etc.;
- if need be, the bearing section bar can be completed with lightning, which is comfortably housed in the lower part of the bearing section bar itself.

It is thus manifest that this system can be used as an alternative to all the existing systems with superstructures opening upwards and with all the types of plates available on the market.

SHORT DESCRIPTION OF THE DRAWINGS

Further characteristics and advantages of the invention will be manifest thanks to the description of one type of preferred, though not exclusive, execution of the system that is the object of the patent, which is illustrated by way of example, and not as limitation, in the attached drawings, in which.

DETAILED DESCRIPTION OF A PREFERRED EXECUTION

Figure 1:
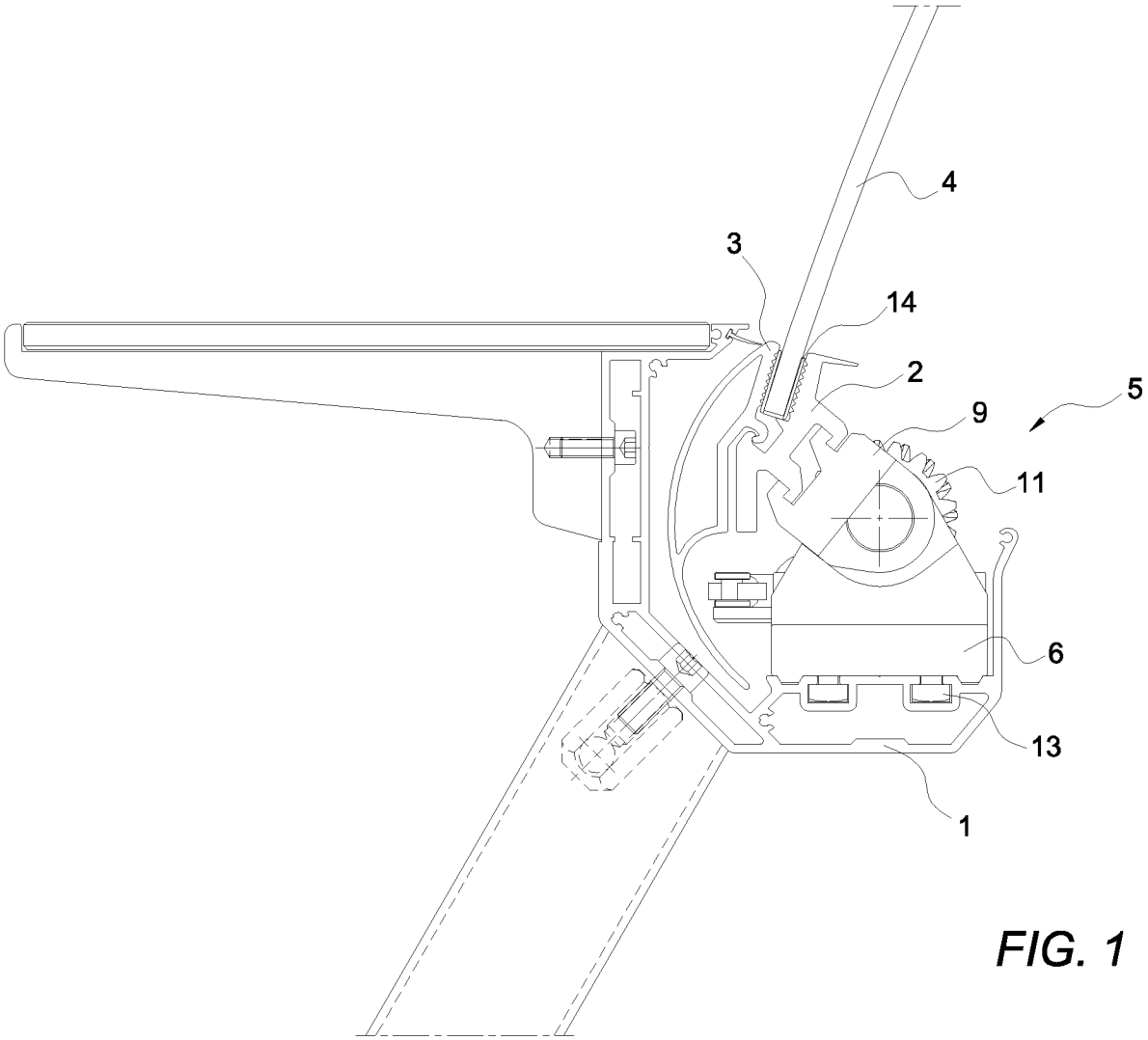
FIG. 1 shows a side view of a counter equipped with the opening system with right angle gearbox at the moment when the plate has been lifted completely.
Figure 2:
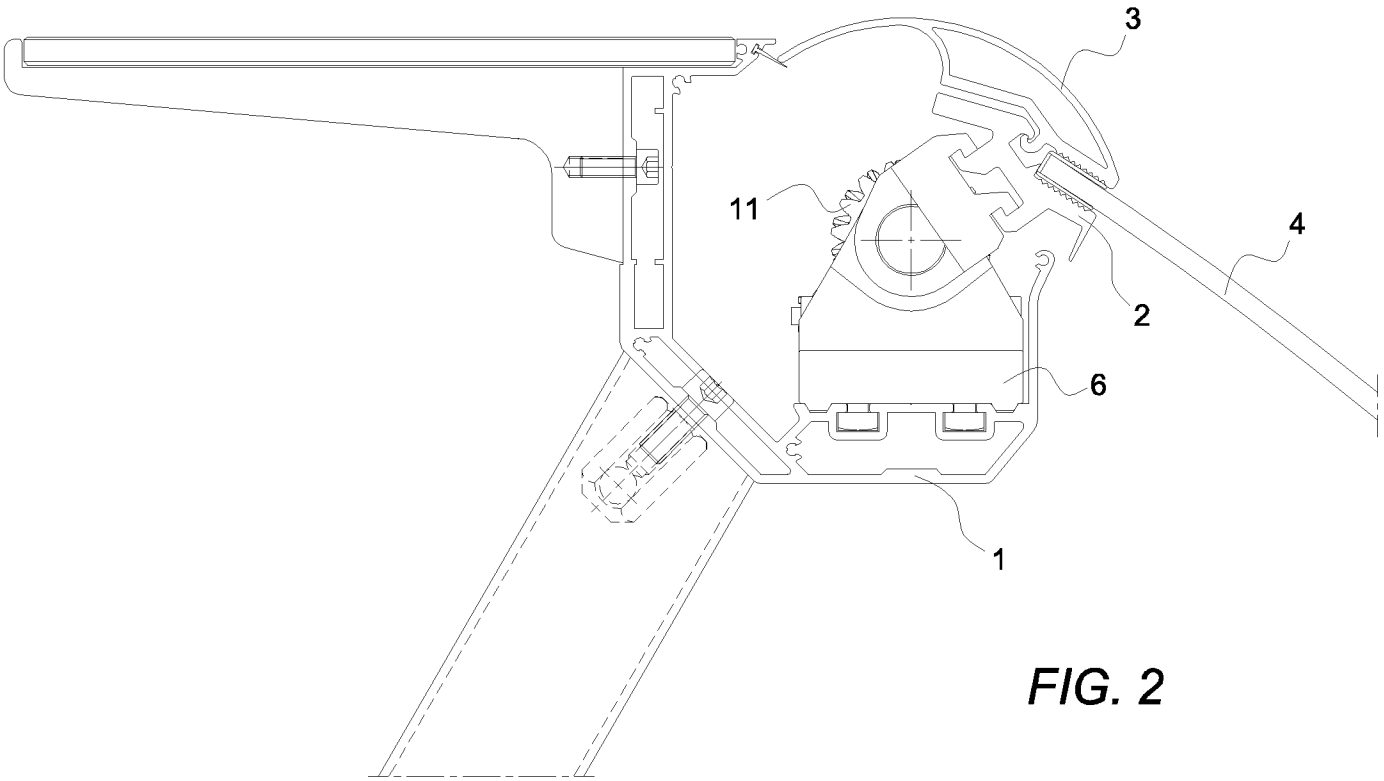
FIG. 2 shows a side view of a counter equipped with the opening system with right angle gearbox at the moment when the plate has been lowered completely.
Figure 3:
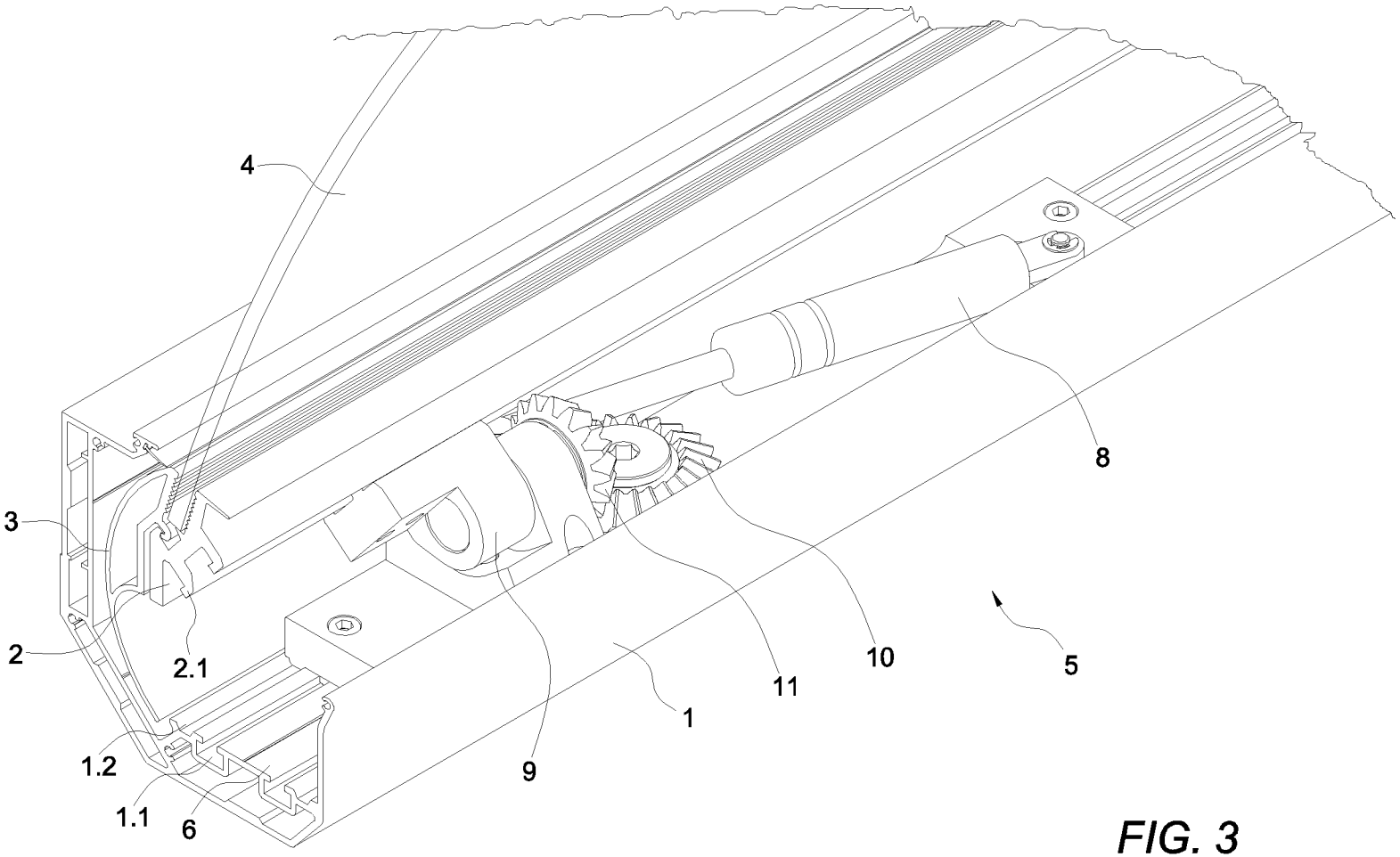
FIG. 3 shows with more details a perspective view of the elements building the opening system with right angle gearbox at the moment when the plate has been lifted completely.
Figure 4:
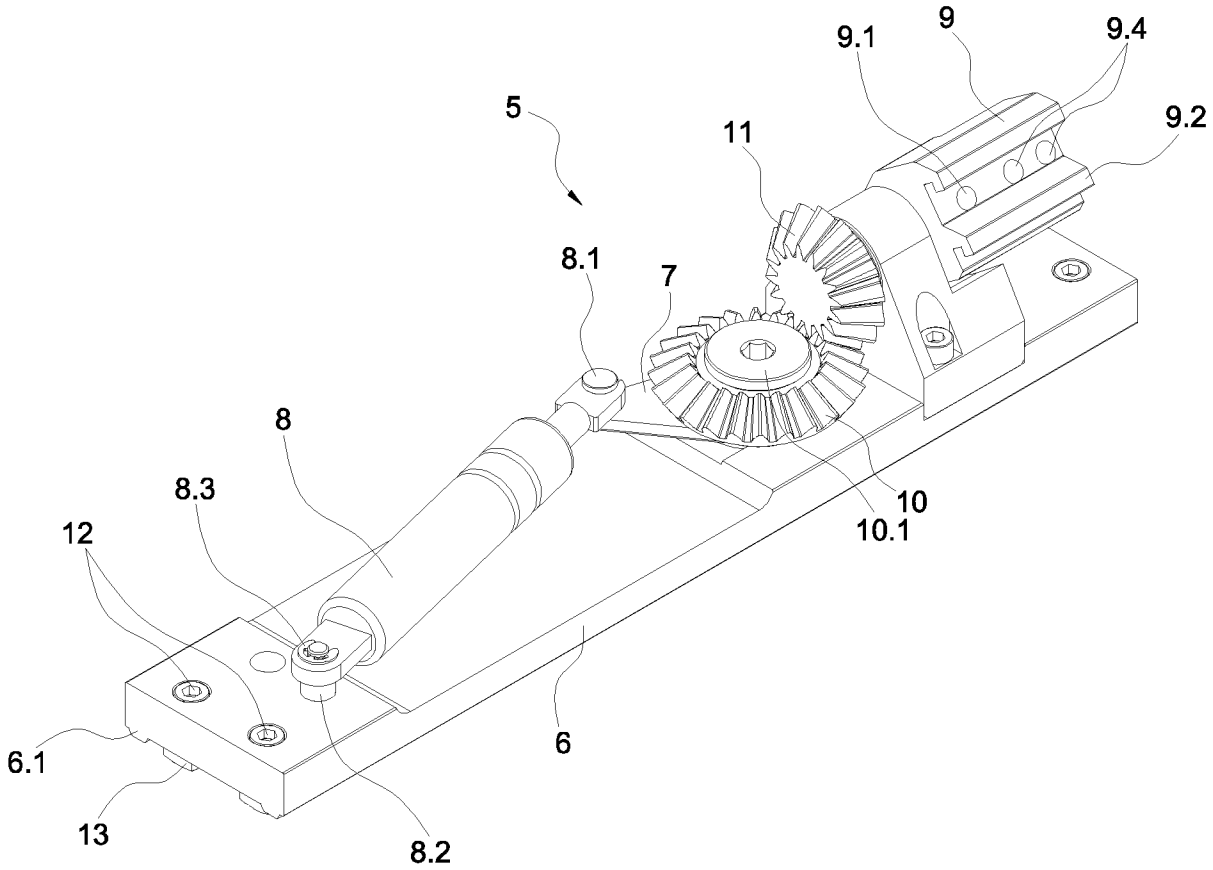
FIGS. 4, 5 show as many perspective views of the moving device of the plate when, respectively, the plate is completely open and completely closed.
Figure 5:
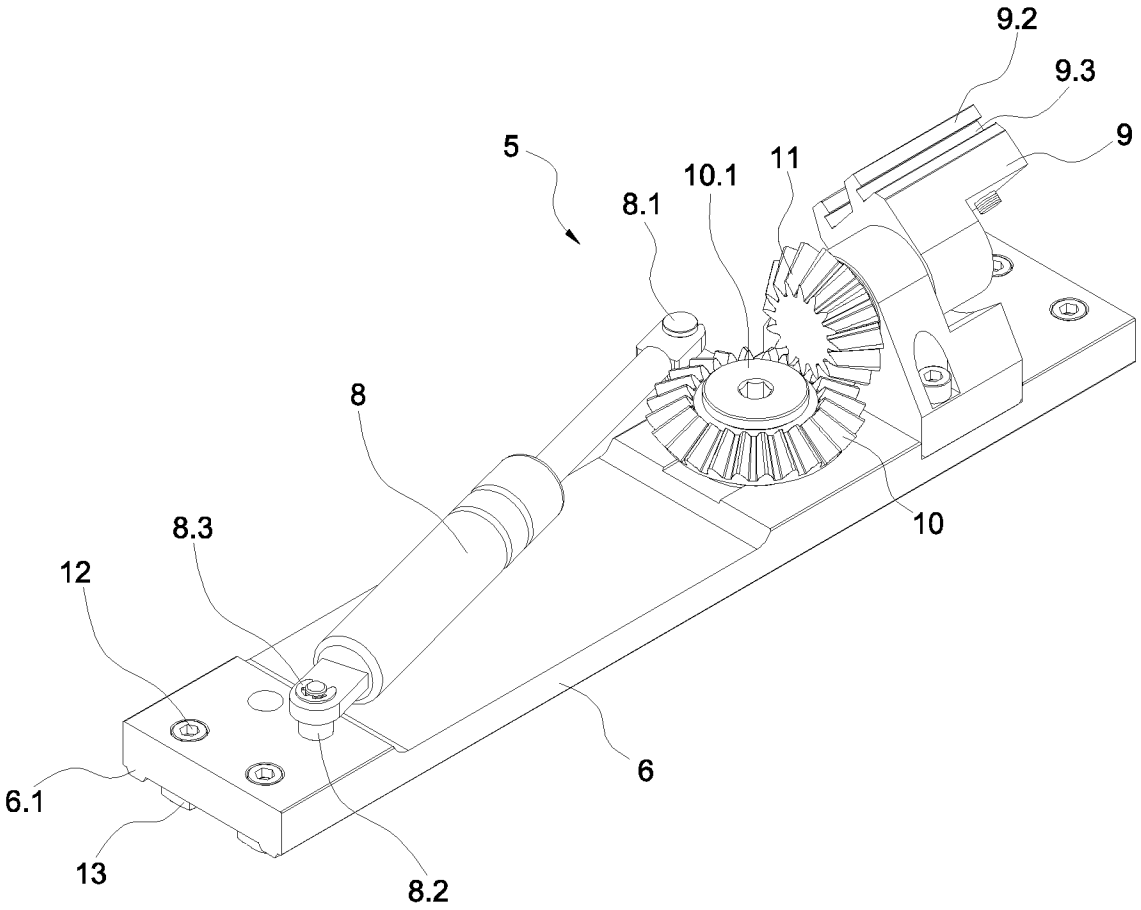

The opening system for display counters that is the object of the patent comprises an upper bearing section bar 1, a gripper for the plate 4 composed of a first section bar 2 and of a second section bar 3 and at least one moving device 5 of the plate 4. The bearing section bar 1 is fastened to the upper ends of the vertical rods of the display counter by means of screws.

Each moving device 5 of the plate 4 comprises a support section bar 6, a right angle gearbox, an arm 7, an element which can take the initial form again as soon as the forces acting on it cease to do so and which is made up of a gas spring 8 as well as a clamp 9. The right angle gearbox is made up of a first conical cogwheel 10 and of a second conical cogwheel 11.

The upper bearing section bar 1 is of the box-type and has in the upper part a series of first female guides 1.1 and a series of second female guides 1.2. The longitudinal axis of each first female guide 1.1 and each second female guide 1.2 is parallel to that of the upper bearing section bar 1 itself.

Usually two moving devices 5 of the plate 4 are used for each plate 4 and gas springs 8 are used which have a power proportional to the weight of the plate 4 itself.

Each support section bar 6, which is extruded and properly shaped, is clamped onto the upper bearing section bar 1 by means of screws 12 and square nuts 13. Each square nut 13 is inserted into a first female guide 1.1 of the bearing section bar 1. Then the screws 12 are inserted into the upper bearing section bar 1 until they enter the square nuts 13 and they are tightened. In order to ensure the correct positioning of the support section bar 6 on the upper bearing section bar 1, the support section bar 6 is equipped in its lower part with male guides 6.1 which are inserted into the second female guides 1.2 on the upper part of the upper bearing section bar 1.

The first conical cogwheel 10 of a right angle gearbox is pivoted onto each support section bar 6. In particular, the first conical cogwheel 10 is pivoted onto the support section bar 6 by means of a calibrated screw 10.1. One end of the arm 7 is fastened to the first conical cogwheel 10 by means of screws.

The end of the rod of the gas spring 8 is pivoted onto the second end of the arm 7 by means of a pin 8.1. The end of the pressure pipe of the gas spring 8 is pivoted onto the support section bar 6 by means of a thrust bearing pin 8.2. A retainer 8.3 (Seeger ring) inserted into the pin 8.2 prevents the gas spring 8 from exiting it.

The second conical cogwheel 11 is clamped in the axial direction onto a clamp 9 by means of a conical peg 9.1 acting on the axis of the second conical cogwheel 11 itself.

The clamp 9 is extruded. In its upper part it is equipped with teeth 9.2 delimiting, together with the body of the clamp 9, two guides 9.3, the longitudinal axis of each of which is parallel to that of the clamp 9.

As described above, the section bars 2, 3 form the gripper for the plate 4. The section bar 2 is also equipped with teeth 2.1, the longitudinal axis of which is parallel to that of the section bar 2 itself. As soon as the plate 4 and a plastic washer 14 are inserted between the section bars 2, 3 and these section bars are clamped to each other by means of socket head screws, the teeth 2.1 of the section bar 2 are inserted into the guides 9.3 of the clamps 9 until they come into contact with the teeth 9.2 of the clamps 9 themselves. Two socket head screws 9.4 are then screwed into each clamp 9 so that they can exercise a compression strength between the clamps 9 and the gripper made of the section bars 2, 3, thus clamping each clamp 9 onto the plate 4 by means of the section bars 2, 3.

When the plate 4 is opened, its upward movement is transferred to each clamp 9 linked to it. The rotary movement of each clamp 9 is transferred to the second conical cogwheel 11 and from it to the first conical cogwheel 10. This cogwheel transfers the radial movement of the plate 4 to the arm 7, to which it is coupled, which thus undergoes a side thrust. The arm 7 acts as lever causing the expansion of the rod of the gas spring 8. The right angle gearbox thus transforms the radial movement of the clamp 9 into an axial movement of the gas spring 8.

When the plate 4 is closed, the gas spring 8 is compressed and thus exercises a force to the arm 7 fastened to the first conical cogwheel 10. This cogwheel transforms the axial movement of the rod of the gas spring 8 into a radial movement of the second conical cogwheel 11, to which it is coupled. The second conical cogwheel 11 transfers the radial force to the clamp 9, which is itself linked to the section bars 2, 3 and the plate 4.

It is thus possible to move the plate during the opening and closing operations easily and with no effort other than the effort needed to lift a plate 4, which is properly servo-assisted by the right angle gearboxes.

The invention claimed is:

1. An opening system with right angle gearbox for facilitating raising and lowering a plate that is pivotally raised and lowered relative to a counter or cabinet to protect items placed within the counter or cabinet, the system comprising an upper bearing section bar adapted to be mounted to an upper end of at least two vertical rods of a counter or cabinet, a gripper for engaging an edge of the plate, the gripper including a first section bar and a second section bar which are mounted to and at least one moving device for the plate, wherein the at least one moving device for the plate includes, a support section bar clamped to the upper bearing section bar, a right angle gearbox including a first conical cogwheel and a second conical cogwheel engaging each other, the first conical cogwheel being pivotally mounted to the support section bar, an end of an arm is fastened to the first conical cogwheel so as to move with the first conical cogwheel, an elastic element having a first end connected to the arm spaced from the first conical cogwheel, a second end of the elastic element is pivotally secured to the support section bar, a clamp mounted to the support section bar and the second conical cogwheel is rotatably mounted to the clamp by a peg, and the two section bars being mounted to the clamp so as to rotate with the peg and the second conical cogwheel.

2. The opening system according to claim 1, wherein the upper bearing section bar is open in cross section and includes first female guide channels and second female guide channels; the longitudinal axis of each first female guide channel and each second female guide channel is parallel to the upper bearing section bar, the support section bar has male guides each haying a longitudinal axis which is parallel to a longitudinal axis of the support section bar, the male guides of the support section bar are housed in second female guide channels of the upper bearing section bar, each support section bar is clamped to the upper bearing section bar by screws and square nuts, and each square nut is housed in one of the first female guides of the upper bearing section bar.

3. The opening system according to claim 1, wherein the clamp includes guide teeth each having a longitudinal axis which is parallel to a longitudinal axis of the clamp, the first section bar forming a portion of the gripper for the plate has teeth each having a longitudinal axis which is parallel to the longitudinal axis of the first section bar; the teeth of the first section bar mounted in the guide teeth of the clamp.

4. The opening system of claim 3 wherein the second section bar is mounted to the first section bar.

5. The opening system according to claim 1, wherein the elastic element is a gas spring; an end of a rod of the gas spring is pivoted to the arm by means of a pin, and an end of a pressure pipe of the gas spring is pivoted to the support section bar.

6. The opening system of claim 1 including a pair of support section bars mounted in spaced relationship to the upper bearing section bar, and a separate moving device mounted to each support section bar.

* * * * *